US009944888B2

(12) United States Patent
Gonzales et al.

(10) Patent No.: US 9,944,888 B2
(45) Date of Patent: Apr. 17, 2018

(54) ALCOHOLS IN LIQUID CLEANING COMPOSITIONS TO REMOVE STAINS FROM SURFACES

(71) Applicant: The Procter & Gamble Company, Cincinnati, OH (US)

(72) Inventors: Denis Alfred Gonzales, Brussels (BE); Aicha Dkidak, Brussels (BE); Patrick Firmin August Delplancke, Steenhuize-Wijnhuize (BE); Robby Renilde Francois Keuleers, Lippeleo (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/355,979

(22) Filed: Nov. 18, 2016

(65) Prior Publication Data

US 2017/0145345 A1 May 25, 2017

(30) Foreign Application Priority Data

Nov. 20, 2015 (EP) ..... 15195709

(51) Int. Cl.

| | |
|---|---|
| ***B08B 3/00*** | (2006.01) |
| ***C11D 1/66*** | (2006.01) |
| ***C11D 3/20*** | (2006.01) |
| ***C11D 11/00*** | (2006.01) |
| ***C11D 17/00*** | (2006.01) |
| ***C11D 3/30*** | (2006.01) |
| ***C11D 1/75*** | (2006.01) |
| ***C11D 3/43*** | (2006.01) |
| ***C11D 3/37*** | (2006.01) |
| ***C11D 1/29*** | (2006.01) |
| ***B08B 3/08*** | (2006.01) |
| ***B08B 1/00*** | (2006.01) |

(52) U.S. Cl.

CPC ..... *C11D 1/66* (2013.01); *B08B 1/006* (2013.01); *B08B 3/003* (2013.01); *B08B 3/08* (2013.01); *C11D 1/29* (2013.01); *C11D 1/75* (2013.01); *C11D 3/201* (2013.01); *C11D 3/2017* (2013.01); *C11D 3/30* (2013.01); *C11D 3/3723* (2013.01); *C11D 3/43* (2013.01); *C11D 11/0023* (2013.01); *C11D 17/0043* (2013.01)

(58) Field of Classification Search

CPC ..... C11D 1/66; C11D 3/3723; B08B 3/003; B08B 3/08; B08B 1/006

See application file for complete search history.

(56) References Cited

U.S. PATENT DOCUMENTS

| | | | | |
|---|---|---|---|---|
| 3,856,695 | A * | 12/1974 | Geiss | C09D 9/005 134/38 |
| 4,430,237 | A * | 2/1984 | Pierce | C11D 1/72 510/237 |
| 4,704,233 | A | 11/1987 | Hartman et al. | |
| 5,549,840 | A * | 8/1996 | Mondin | A01N 37/10 252/299.01 |
| 6,617,303 | B1 * | 9/2003 | Smith | C11D 1/44 510/336 |
| 6,855,677 | B1 * | 2/2005 | Matsumoto | A61K 8/34 424/70.23 |
| 7,629,305 | B1 * | 12/2009 | Szekeres | C11D 3/386 510/331 |
| 2003/0232737 | A1 * | 12/2003 | Stoessel | C11D 3/0057 510/417 |
| 2005/0192199 | A1 * | 9/2005 | Cartwright | C11D 3/222 510/420 |
| 2008/0051312 | A1 | 2/2008 | Lestage et al. | |
| 2011/0160116 | A1 * | 6/2011 | Mckechnie | C11D 1/66 510/362 |
| 2013/0296213 | A1 * | 11/2013 | Isobe | C11D 3/2065 510/161 |
| 2014/0296124 | A1 | 10/2014 | Hulskotter et al. | |
| 2015/0275142 | A1 * | 10/2015 | Hulskotter | C11D 3/3723 510/320 |
| 2015/0315522 | A1 * | 11/2015 | Hulskotter | C11D 1/94 510/235 |
| 2015/0315524 | A1 * | 11/2015 | Hulskotter | C11D 3/3707 510/235 |
| 2016/0222319 | A1 * | 8/2016 | Goodwin | C11D 1/74 |
| 2017/0121635 | A1 * | 5/2017 | Delplancke | C11D 1/75 |
| 2017/0121637 | A1 * | 5/2017 | Delplancke | C11D 1/75 |
| 2017/0121638 | A1 * | 5/2017 | Delplancke | C11D 1/75 |

FOREIGN PATENT DOCUMENTS

| | | | |
|---|---|---|---|
| CA | 2816064 | * | 7/2014 |
| EP | 0 666 308 | A2 | 8/1995 |
| EP | 2 025 743 | A1 | 2/2009 |
| EP | 2 272 942 | A1 | 1/2011 |
| JP | 2007 016131 | A | 1/2007 |
| JP | 2007 016132 | A | 1/2007 |
| JP | 2008 260852 | A1 | 10/2008 |

(Continued)

OTHER PUBLICATIONS

E. Schnell et al.: "Properties of a New Hydrotrope Hydrophobic Molecule and Its Potential Applications" International Journal of Cosmetic Science, vol. 30, No. 5, Oct. 1, 2008, pp. 347-351, XP55191335.

(Continued)

*Primary Examiner* — Sharidan Carrillo

(74) *Attorney, Agent, or Firm* — Lauren Christine Gonzalez

(57) ABSTRACT

The use of an alcohol in a liquid cleaning composition including surfactant, for cleaning hydrophobic stains from surfaces and/or for providing suds longevity, wherein the alcohol is selected from the group consisting of: C4-C6 linear mono-alcohols, branched C4-C10 mono-alcohols having one or more C1-C4 branching groups, alkyl mono-glycerols, and mixtures thereof.

15 Claims, No Drawings

(56) References Cited

FOREIGN PATENT DOCUMENTS

| | | | |
|---|---|---|---|
| WO | WO 98/04761 | A1 | 2/1998 |
| WO | WO 99/05082 | A1 | 2/1999 |
| WO | WO 99/05084 | A1 | 2/1999 |
| WO | WO 99/05241 | A1 | 2/1999 |
| WO | WO 99/05242 | A1 | 2/1999 |
| WO | WO 99/05243 | A1 | 2/1999 |
| WO | WO 99/05244 | A1 | 2/1999 |
| WO | WO 99/07656 | A1 | 2/1999 |
| WO | WO 00/23548 | A1 | 4/2000 |
| WO | WO 00/23549 | A1 | 4/2000 |
| WO | WO 00/71652 | A2 | 11/2000 |
| WO | WO 2008/010606 | A1 | 1/2008 |

OTHER PUBLICATIONS

Extended European Search Report for Application No. 15195709.
9-1375, dated Jul. 5, 2016, 20 pages.

* cited by examiner

ALCOHOLS IN LIQUID CLEANING COMPOSITIONS TO REMOVE STAINS FROM SURFACES

FIELD OF THE INVENTION

Uses and methods for removing stains from surfaces, especially hydrophobic stains, and for providing improved suds longevity, especially during a hard surface cleaning process.

BACKGROUND OF THE INVENTION

Hydrophobic stains, especially oils, fats, and polymerised grease, are often present on surfaces such as floors, kitchen counters, pots, pans, and dishes, and even on fabrics. Such hydrophobic stains are challenging to remove from surfaces, especially ceramics and surfaces that are at least partially porous, and especially after the hydrophobic material has been left on the surface for extended periods. Moreover, during domestic (in home) use, compositions which are known as being tough on oils and grease can often be harsh on skin, especially sensitive skin, especially those having a high pH.

Moreover, high pH compositions can be challenging for the stability of many functional ingredients, including enzymes, perfumes, dyes preservatives, and the like. In addition, high pH can result in damage to delicate surfaces.

Moreover, suds longevity can be challenging, especially in the presence of hydrophobic residues. Since users can equate low suds with low cleaning effectiveness, especially when cleaning hard to remove stains, such low suds can lead to dissatisfaction during use of the cleaning composition.

As such, a need remains for stable compositions which provide improved means of removing such stains from surfaces, especially porous or delicate surfaces.

SUMMARY OF THE INVENTION

The present invention relates to the use of alcohols in liquid cleaning compositions comprising surfactant and preferably having a pH of less than 10, for treating hydrophobic stains from surfaces, and/or for providing suds longevity. The present invention further related to a method of removing hydrophobic stains from a surface. The present invention further relates to liquid cleaning composition for treating hydrophobic stains on surfaces, preferably having a pH of less than 10 and comprising: a surfactant, a glycol ether solvent, and a chelant.

DETAILED DESCRIPTION OF THE INVENTION

Compositions comprising the alcohols of the invention have been found to be particularly suited for treating hydrophobic stains selected from oils, fats, polymerized grease, and mixtures thereof.

Oils are nonpolar substances which are liquid at ambient temperatures (21° C.), and are both hydrophobic (immiscible with water) and lipophilic (miscible with other oils and organic solvents). Oils typically have a high carbon and hydrogen content. Oil includes classes of chemical compounds that may be otherwise unrelated in structure, properties, and uses. Oils may be derived from animal, vegetable, or petrochemicals sources. They are typically used for food, fuel, lubrication, and the manufacture of paints, plastics, and other materials.

Fats are soft greasy solids at ambient temperatures (21° C.), and are also both hydrophobic (immiscible with water) and lipophilic (miscible with other oils and organic solvents). Fats may be animal, vegetable, or petrochemical in origin. They are also typically used for food, fuel, lubrication, and the manufacture of paints, plastics, and other materials.

Polymerised grease are cooked-, baked- or burnt-on oils and fats that have been heated to a temperature, of left sufficiently long, that they polymerise and typically also have an increased viscosity.

Liquid cleaning compositions comprising the alcohols, as described herein, are particularly suitable for treating oils, fats, and polymerized grease which have been derived from animal, or vegetable sources, especially vegetable sources, and most especially vegetable sources selected from: sesame oil, canola oil, olive oil, rapeseed oil, coconut oil, corn oil, peanut oil, sunflower oil and mixtures thereof.

Moreover, such compositions also provide a more enduring suds profile, even during the treatment of hydrophobic stains. The improved suds sustainability provides the users with an indication of the continued effectiveness of the liquid cleaning composition during use.

A composition for the use and methods of the invention is herein sometimes referred to as "composition of the invention".

As defined herein, "essentially free of" a component means that no amount of that component is deliberately incorporated into the respective premix, or composition. Preferably, "essentially free of" a component means that no amount of that component is present in the respective premix, or composition.

All percentages, ratios and proportions used herein are by weight percent of the premix, unless otherwise specified. All average values are calculated "by weight" of the premix, unless otherwise expressly indicated.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Alcohol

The composition of the invention comprises from 0.1 to 10%, preferably from 1 to 9%, more preferably from 2 to 8%, most preferably from 4 to 6% by weight of the composition of an alcohol selected from the group consisting of C4-C6 linear mono-alcohols, branched C4-C10 mono-alcohols having one or more C1-C4 branching groups, alkyl mono-glycerols, and mixtures thereof.

Preferred C4-C6 linear mono-alcohols are selected from pentanol, hexanol, and mixtures thereof, preferably 1-pentanol, 1-hexanol, and mixtures thereof.

Preferred branched C4-C10 mono-alcohols having one or more C1-C4 branching groups for use herein are C4-C8 primary mono-alcohols having one or more C1-C4 branching groups. Especially preferred branched C4-C10 mono-alcohols having one or more C1-C4 branching groups for use herein include methyl butanol, ethyl butanol, methyl pentanol, ethyl pentanol, methyl hexanol, ethyl hexanol, propyl hexanol, dimethyl hexanol trimethyl hexanol, methyl hepanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol, trimethyl nonanol and mixtures thereof. More preferably are the primary 1-alcohol members of branched C4-C10 mono-alcohols having one or more C1-C4 branching groups for use herein include the primary 1-alcohol family members of methyl butanol, ethyl butanol, methyl pentanol, ethyl pentanol, methyl hexanol, ethyl hexanol, propyl hexanol, dimethyl hexanol trimethyl hexanol, methyl hepanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol, trimethyl nonanol and mixtures thereof.

More preferred alcohols are butyl octanol, trimethyl hexanol, ethyl hexanol, propyl heptanol, methyl butanol, and mixtures thereof, in particular the primary 1-alcohol family member, more in particular ethyl hexanol, butyl octanol and trimethyl hexanol especially 2-ethyl-1-hexanol, 2-butyl-1-octanol and 3,5,5 trimethyl-1-hexanol, and mixtures thereof.

Preferred alkyl glycerols are selected from the group consisting of branched alkyl glycerols and mixtures thereof, more preferably branched C4-C8 alkyl glycerols with one or more C1 to C4 alkyl branching groups, more preferably selected from the group consisting of ethylhexylglycerol, propylheptylglycerol, and mixtures thereof, most preferably 2-ethylhexylglycerol.

The alcohol of the product of the invention can boost foaming.

Especially preferred for use herein are mixtures of mono-alcohols, in particular mixtures comprising a branched C4-C10 mono-alcohol, more in particular mixtures comprising an alcohol selected from the group comprising C4-C8 more preferably C6-C7 branched primary alcohols. Preferably for use is a mixture of alcohols comprising an alcohol selected from the group comprising C4-C8 branched primary alcohols with an alcohol selected of the group of C4-C6 linear mono-alcohols and alkylglycerols. Mixtures can boost foaming and work better on soils containing a plurality of oils.

Liquid Cleaning Composition:

The liquid cleaning composition, for use in the present invention, comprises an alcohol as described herein.

Preferably, the liquid cleaning compositions herein are aqueous compositions. Therefore, they may comprise from 30% to 99.5% by weight of the total composition of water, preferably from 40% to 98% and more preferably from 50% to 85%.

Preferably, the pH of the liquid cleaning composition is less than 10. The pH can be from 7.0 to 10, more preferably from 8.0 to 9.5. It is believed that the aforementioned pH range, in combination with the alcohol, results in improved greasy soil and particulate greasy soil cleaning removal, and improved suds longevity while being safe and more delicate. Accordingly, the compositions herein may further comprise an acid or base to adjust pH as appropriate.

Alternatively, and especially where limescale treatment is desired, the pH can be acidic. That is, less than 7, preferably from 1 to 6.5, more preferably from 1.5 to 3.5, most preferably from 2.0 to 4.

A suitable acid for use herein is an organic and/or an inorganic acid. A preferred organic acid for use herein has a pKa of less than 6. A suitable organic acid is selected from the group consisting of: citric acid, lactic acid, glycolic acid, succinic acid, glutaric acid and adipic acid and mixtures thereof. A suitable inorganic acid can be selected from the group consisting of: hydrochloric acid, sulphuric acid, phosphoric acid and mixtures thereof.

A typical level of such acids, when present, is from 0.01% to 8.0% by weight of the total composition, preferably from 0.5% to 5.0% and more preferably from 1.0% to 3.0%.

The compositions herein can comprise lactic acid. It has been found that the presence of lactic acid additionally provides antimicrobial/disinfecting benefits to the compositions according to the present invention. The compositions according to the present invention may comprise up to 10% by weight of the total composition of lactic acid, preferably from 0.1% to 6%, more preferably from 0.2% to 5.0%, even more preferably from 0.5% to 4.0%, and most preferably from 1.0% to 3.0%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (such as monoethanolamine, triethanolamine, aminomethylpropanol, and mixtures thereof). Alkanolamines, especially methanolamine, are particularly preferred.

Typical levels of such bases, when present, are from 0.01% to 5.0% by weight of the total composition, preferably from 0.05% to 3.0% and more preferably from 0.1% to 2.0%.

For improved stain penetration, the liquid hard surface treatment composition preferably has a reserve alkalinity of from about 0.1 to about 1, preferably from 0.2 to 0.7, more preferably from 0.3 to 0.5 expressed as g NAOH/100 ml of composition at a pH of 7.

All ratios are calculated as a weight/weight level, unless otherwise specified.

Glycol Ether Solvents:

The glycol ether solvents, described herein, provide improved removal of hydrophobic stains, especially stains comprising oils, fats, and polymerized grease which have been derived from animal, or vegetable sources, more especially vegetable oils. They also further improve the suds longevity profile of the composition. The glycol ether solvents are selected from the glycol ethers of Formula 1 or Formula 2.

$R_1O(R_2O)_nR_3$ Formula 1:

wherein $R_1$ is a linear or branched $C_4$, $C_5$ or $C_6$ alkyl, a substituted or unsubstituted phenyl, preferably n-butyl. Benzyl is one of the substituted phenyls for use herein.

$R_2$ is ethyl or isopropyl, preferably isopropyl $R_3$ is hydrogen or methyl, preferably hydrogen n is 1, 2 or 3, preferably 1 or 2

$R_4O(R_5O)_mR_6$ Formula 2:

wherein $R_4$ is n-propyl or isopropyl, preferably n-propyl $R_5$ is isopropyl $R_6$ is hydrogen or methyl, preferably hydrogen m is 1, 2 or 3 preferably 1 or 2

Suitable glycol ether solvents according to Formula 1 include ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, ethyleneglycol n-pentyl ether, diethyleneglycol n-pentyl ether, triethyleneglycol n-pentyl ether, propyleneglycol n-pentyl ether, dipropyleneglycol n-pentyl ether, tripropyleneglycol n-pentyl ether, ethyleneglycol n-hexyl ether, diethyleneglycol n-hexyl ether, triethyleneglycol n-hexyl ether, propyleneglycol n-hexyl ether, dipropyleneglycol n-hexyl ether, tripropyleneglycol n-hexyl ether, ethyleneglycol phenyl ether, diethyleneglycol phenyl ether, triethyleneglycol phenyl ether, propyleneglycol phenyl ether, dipropyleneglycol phenyl ether, tripropyleneglycol phenyl ether, ethyleneglycol benzyl ether, diethyleneglycol benzyl ether, triethyleneglycol benzyl ether, propyleneglycol benzyl ether, dipropyleneglycol benzyl ether, tripropyleneglycol benzyl ether, ethyleneglycol isobutyl ether, diethyleneglycol isobutyl ether, triethyleneglycol isobutyl ether, propyleneglycol isobutyl ether, dipropyleneglycol isobutyl ether, tripropyleneglycol isobutyl ether, ethyleneglycol isopentyl ether, diethyleneglycol isopentyl ether, triethyleneglycol isopentyl ether, propyleneglycol isopentyl ether, dipropyleneglycol isopentyl ether, tripropyleneglycol isopentyl ether, ethyleneglycol isohexyl ether, diethyleneglycol isohexyl ether, triethyleneglycol isohexyl ether, propyleneglycol isohexyl ether, dipropyleneglycol isohexyl ether, tripropyleneglycol isohexyl ether, ethyleneglycol n-butyl methyl ether, diethyleneglycol n-butyl methyl ether triethyleneglycol n-butyl methyl ether, propyleneglycol n-butyl methyl ether, dipropyleneglycol n-butyl methyl ether, tripropyleneglycol n-butyl methyl ether, ethyleneglycol n-pentyl methyl ether, diethyleneglycol n-pentyl methyl ether, triethyleneglycol n-pentyl methyl ether, propyleneglycol n-pentyl methyl ether, dipropyleneglycol n-pentyl methyl ether, tripropyleneglycol n-pentyl methyl ether, ethyleneglycol n-hexyl methyl ether, diethyleneglycol n-hexyl methyl ether, triethyleneglycol n-hexyl methyl ether, propyleneglycol n-hexyl methyl ether, dipropyleneglycol n-hexyl methyl ether, tripropyleneglycol n-hexyl methyl ether, ethyleneglycol phenyl methyl ether, diethyleneglycol phenyl methyl ether, triethyleneglycol phenyl methyl ether, propyleneglycol phenyl methyl ether, dipropyleneglycol phenyl methyl ether, tripropyleneglycol phenyl methyl ether, ethyleneglycol benzyl methyl ether, diethyleneglycol benzyl methyl ether, triethyleneglycol benzyl methyl ether, propyleneglycol benzyl methyl ether, dipropyleneglycol benzyl methyl ether, tripropyleneglycol benzyl methyl ether, ethyleneglycol isobutyl methyl ether, diethyleneglycol isobutyl methyl ether, triethyleneglycol isobutyl methyl ether, propyleneglycol isobutyl methyl ether, dipropyleneglycol isobutyl methyl ether, tripropyleneglycol isobutyl methyl ether, ethyleneglycol isopentyl methyl ether, diethyleneglycol isopentyl methyl ether, triethyleneglycol isopentyl methyl ether, propyleneglycol isopentyl methyl ether, dipropyleneglycol isopentyl methyl ether, tripropyleneglycol isopentyl methyl ether, ethyleneglycol isohexyl methyl ether, diethyleneglycol isohexyl methyl ether, triethyleneglycol isohexyl methyl ether, propyleneglycol isohexyl methyl ether, dipropyleneglycol isohexyl methyl ether, tripropyleneglycol isohexyl methyl ether, and mixtures thereof.

Preferred glycol ether solvents according to Formula 1 are ethyleneglycol n-butyl ether, diethyleneglycol n-butyl ether, triethyleneglycol n-butyl ether, propyleneglycol n-butyl ether, dipropyleneglycol n-butyl ether, tripropyleneglycol n-butyl ether, and mixtures thereof.

Most preferred glycol ethers according to Formula 1 are propyleneglycol n-butyl ether, dipropyleneglycol n-butyl ether, and mixtures thereof.

Suitable glycol ether solvents according to Formula 2 include propyleneglycol n-propyl ether, dipropyleneglycol n-propyl ether, tripropyleneglycol n-propyl ether, propyleneglycol isopropyl ether, dipropyleneglycol isopropyl ether, tripropyleneglycol isopropyl ether, propyleneglycol n-propyl methyl ether, dipropyleneglycol n-propyl methyl ether, tripropyleneglycol n-propyl methyl ether, propyleneglycol isopropyl methyl ether, dipropyleneglycol isopropyl methyl ether, tripropyleneglycol isopropyl methyl ether, and mixtures thereof.

Preferred glycol ether solvents according to Formula 2 are propyleneglycol n-propyl ether, dipropyleneglycol n-propyl ether, and mixtures thereof.

Most preferred glycol ether solvents are propyleneglycol n-butyl ether, dipropyleneglycol n-butyl ether, and mixtures thereof, especially dipropyleneglycol n-butyl ether.

Suitable glycol ether solvents can be purchased from The Dow Chemical Company, more particularly from the E-series (ethylene glycol based) Glycol Ethers and the P-series (propylene glycol based) Glycol Ethers line-ups. Suitable glycol ether solvents include Butyl Carbitol, Hexyl Carbitol, Butyl Cellosolve, Hexyl Cellosolve, Butoxytriglycol, Dowanol Eph, Dowanol PnP, Dowanol DPnP, Dowanol PnB, Dowanol DPnB, Dowanol TPnB, Dowanol PPh, and mixtures thereof.

The glycol ether of the product of the invention can boost foaming.

Mixtures of an alcohol, in particular a C4-C8 branched primary mono-alcohol with a glycol ether of Formula I, II or mixtures thereof have also been found to provide an unexpected good cleaning and speed of cleaning. Ethylhexanol especially 2-ethyl-1-hexanol, propylhexanol especially 2-propyl-1-heptanol, and methyl hexanol, in particular trimethyl hexanol especially 3,5,5 trimethyl-1-hexanol, have been found particularly good when they are part of a mixture, in terms of cleaning and speed of cleaning, especially mixtures of these alcohols with propyleneglycol n-butyl ether, dipropyleneglycol n-butyl ether, and mixtures thereof, especially dipropyleneglycol n-butyl ether.

The mixtures of alcohols and glycol ethers can boost foaming and work better across a plurality of different oily soils.

Preferably the glycol ether and the alcohol are in a weight ratio of from about 9:1 to about 1:9, preferably from about 7:3 to 3:7 and more preferably from about 3:2 to 2:3.

The glycol ether solvent is typically present at a level of less than 10%, more preferably from 1% to 7% by weight of the composition.

Cleaning Amine

The composition of the invention preferably comprises from about 0.1% to about 10%, more preferably from about 0.2% to about 5%, and especially from about 0.3% to about 2%, by weight of the composition, of a cleaning amine. The term "cleaning amine" herein encompasses a single cleaning amine and a mixture thereof. A "cleaning amine" herein means a molecule comprising amine functionalities that helps cleaning as part of a cleaning composition.

The amine can be subjected to protonation depending on the pH of the cleaning medium in which it is used.

Preferably the cleaning amine is a cyclic diamine of Formula (I):

(I)

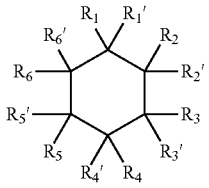

two of the substituents $R_s$($R_1$-$R_6$, $R_1$'-$R_6$') are independently selected from the group consisting of NH2, (C1-C4)NH2 and mixtures thereof and the remaining substituents $R_s$ are independently selected from H, linear or branched alkyl or alkenyl having from 1 to 10 carbon atoms.

The term "cyclic diamine" herein encompasses a single cleaning amine and a mixture thereof. The amine can be subjected to protonation depending on the pH of the cleaning medium in which it is used.

The amine of Formula (I) is a cyclic amine with two primary amine functionalities. The primary amines can be in any position in the cycle but it has been found that in terms of grease cleaning, better performance can be obtained when the primary amines are in positions 1,3. It has also been found advantageous in terms of grease cleaning amines in which one of the substituents is —CH3 and the rest are H.

Preferred cyclic diamines for use herein are selected from the group consisting of:

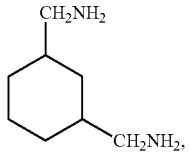

1,3-bis(methylamine)-cyclohexane

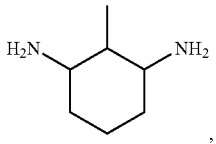

2-methylcyclohexane-1,3-diamine

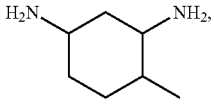

4-methylcyclohexane-1,3-diamine

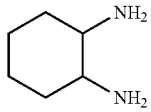

Cyclohexane-1,2-diamine

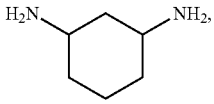

Cyclohexane-1,3-diamine

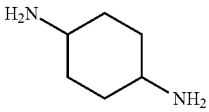

Cyclohexane-1,4-diamine

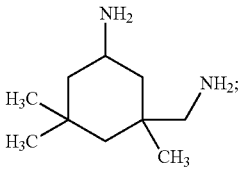

Isophorone diamine and a mixture thereof.

Especially preferred for use herein are cyclic diamines selected from the group consisting of 1, 3-bis(methylamine)-cyclohexane, 2-methylcyclohexane-1,3-diamine, 4-methylcyclohexane-1,3-diamine and mixtures thereof. 1, 3-bis (methylamine)-cyclohexane is especially preferred for use herein. Mixtures of 2-methylcyclohexane-1,3-diamine, 4-methylcyclohexane-1,3-diamine are also preferred for use herein.

Preferred cleaning amines include polyetheramines. One of the polyetheramine preferred for use in the composition of the invention is represented by the structure of Formula (I):

Formula (I)

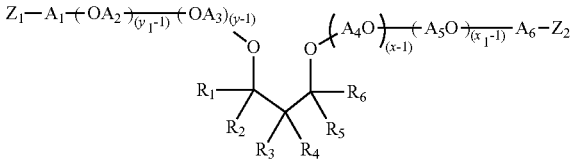

where each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, typically about 2 to about 20, more typically about 2 to about 10 or about 3 to about 8 or about 4 to about 6, where x≥1 and y≥1, and the sum of $x_1+y_1$ is in the range of about 2 to about 200, typically about 2 to about 20, more typically about 2 to about 10 or about 3 to about 8 or about 2 to about 4, where $x_1 \geq 1$ and $y_1 \geq 1$.

Preferably in the polyetheramine of Formula (I), each of $A_1$-$A_6$ is independently selected from ethylene, propylene, or butylene, typically each of $A_1$-$A_6$ is propylene. More preferably, in the polyetheramine of Formula (I), each of $R_1$, $R_2$, $R_5$, and $R_6$ is H and each of $R_3$ and $R_4$ is independently selected from C1-C16 alkyl or aryl, typically each of $R_1$, $R_2$, $R_5$, and $R_6$ is H and each of $R_3$ and $R_4$ is independently selected from a butyl group, an ethyl group, a methyl group, a propyl group, or a phenyl group. More preferably, in the polyetheramine of Formula (I), $R_3$ is an ethyl group, each of $R_1$, $R_2$, $R_5$, and $R_6$ is H, and $R_4$ is a butyl group. Especially, in the polyetheramine of Formula (I), each of $R_1$ and $R_2$ is H and each of $R_3$, $R_4$, $R_5$, and $R_6$ is independently selected from an ethyl group, a methyl group, a propyl group, a butyl group, a phenyl group, or H.

In the polyetheramine represented by the structure of Formula (II):

Formula (II)

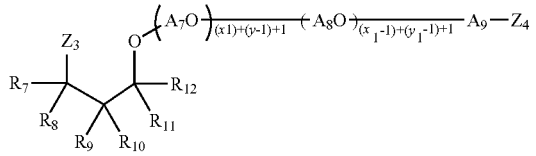

each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, each of $Z_3$-$Z_4$ is independently selected from OH or $NH_2$, where at least one of $Z_3$-$Z_4$ is $NH_2$, typically each of $Z_3$ and $Z_4$ is $NH_2$, where the sum of x+y is in the range of about 2 to about 200, typically about 2 to about 20, more typically about 2 to about 10 or about 3 to about 8 or about 2 to about 4, where x≥1 and y≥1, and the sum of $x_1+y_1$ is in the range of about 2 to about 200, typically about 2 to about 20, more typically about 2 to about 10 or about 3 to about 8 or about 2 to about 4, where $x_1 \geq 1$ and $y_1 \geq 1$.

Preferably in the polyetheramine of Formula (II), each of $A_7$-$A_9$ is independently selected from ethylene, propylene, or butylene, typically each of $A_7$-$A_9$ is propylene. More preferably, in the polyetheramine of Formula (II), each of $R_7$, $R_8$, $R_{11}$, and $R_{12}$ is H and each of $R_9$ and $R_{10}$ is independently selected from C1-C16 alkyl or aryl, typically each of $R_7$, $R_8$, $R_{11}$, and $R_{12}$ is H and each of $R_9$ and $R_{10}$ is independently selected from a butyl group, an ethyl group, a methyl group, a propyl group, or a phenyl group. More preferably, in the polyetheramine of Formula (II), $R_9$ is an ethyl group, each of $R_7$, $R_8$, $R_{11}$, and $R_{12}$ is H, and $R_{10}$ is a butyl group. In some aspects, in the polyetheramine of Formula (II), each of $R_7$ and $R_8$ is H and each of $R_9$, $R_{10}$, $R_{11}$, and $R_{12}$ is independently selected from an ethyl group, a methyl group, a propyl group, a butyl group, a phenyl group, or H.

Preferred polyetheramines are selected from the group consisting of Formula A, Formula B, and mixtures thereof:

Formula A

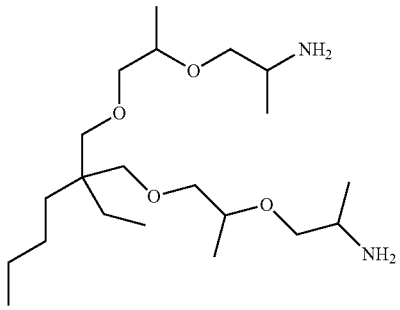

Formula B

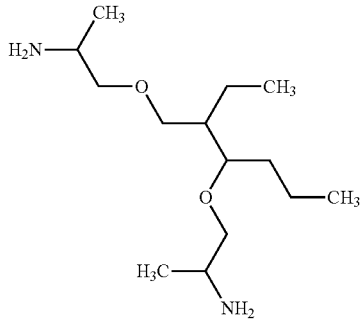

Preferably, the polyetheramine comprises a mixture of the compound of Formula (I) and the compound of Formula (II).

Typically, the polyetheramine of Formula (I) or Formula (II) has a weight average molecular weight of less than about grams/mole 1000 grams/mole, preferably from about 100 to about 800 grams/mole, more preferably from about 200 to about 450 grams/mole.

Amine of Formula (1):

The cleaning amine of Formula (1) has an ethylene diamine core with at least one primary amine functionality. The cleaning amine also comprises at least another nitrogen atom, preferable in the form of a tertiary amine functionality. Herein the term "core" refers to the alkyl chain between two nitrogen radicals. The number of carbons in the core does not include the radicals attached to the core.

The Cleaning Amine has the Formula:

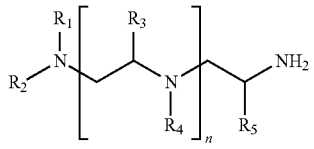

wherein: $R_1$, $R_2$, $R_3$, $R_4$, and $R_5$ are independently selected from —H, linear, branched or cyclic alkyl or alkenyl having from 1 to 10 carbon atoms and n=0-3.

Preferably, the cleaning amine is aliphatic in nature. The cleaning amine preferably has a molecular weight of less than about 1000 grams/mole and more preferably less than about 450 grams/mole.

"n" varies from 0 to not more than 3, preferably "n" is 0. The amine molecule contains at least one primary amine functionality and preferably a tertiary amine functionality.

Suitable cleaning amines for use herein include amines wherein $R_1$ and $R_2$ are selected from isopropyl and butyl, preferably $R_1$ and $R_2$ are both isopropyl or both butyl.

Preferably cleaning amines include those in which R1 and R2 are isopropyl and preferably, n is 0. Also preferred are amines in which R1 and R2 are butyl and preferably, n is 0

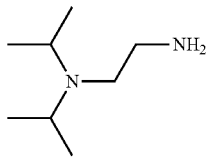

$N_1$, $N_1$-diisopropylethane-1,2-diamine

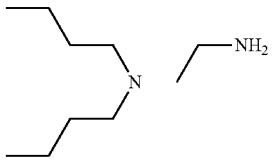

$N^1$, $N^1$-dibutylethane-1,2-diamine

R5 is preferably —CH3 or —CH2CH3. Cleaning amines in which R5 is —CH3 or —CH2CH3 could be good in terms of composition stability. Without being bound by theory, it is believed that the methyl or ethyl radical can provide stearic hinderance that protects the cleaning amine from negative interaction with other components of the cleaning composition.

Amine of Formula (2):

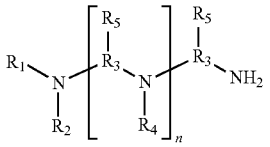

wherein $R_1$ and $R_4$ are independently selected from —H, linear, branched or cyclic alkyl or alkenyl; having from 1 to 10 carbon atoms and $R_2$ is a linear, branched or cyclic alkyl or alkenyl having from 3 to 10 carbons, $R_3$ is a linear or branched alkyl from 3 to 6 carbon atoms, $R_5$ is H, methyl or ethyl and is preferably located in alpha position from the amine functionality/ies, and n=0-3.

The cleaning amine of formula (2) has a C3-C6 diamine core with at least one of the amine functionalities being a primary amine Herein the term "core" refers to the alkyl chain between two nitrogen radicals. The number of carbons in the core does not include the radicals attached to the core.

The cleaning amine of formula (2) preferably has a molecular weight of less than about 1000 grams/mole and more preferably less than about 450 grams/mole.

"n" varies from 0 to not more than 3, preferably "n" is 0. The amine molecule contains at least one primary amine functionality and preferably a tertiary amine functionality.

Suitable cleaning amines include amines wherein $R_1$ and $R_2$ are selected from propyl, butyl and hexyl, preferably $R_1$ and $R_2$ are both propyl, butyl or hexyl. Preferably n is 0.

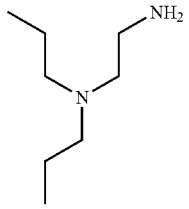

N'N'-dipropylpropane 1,3 1diamine

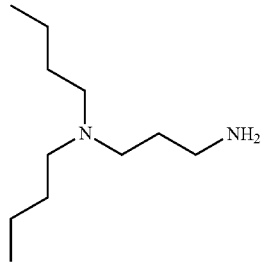

$N^1$, $N^1$-dibutylpropane-1,3-diamine

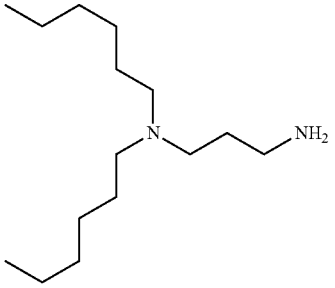

$N^1$, $N^1$-dihexylpropane-1,3-diamine

Another preferred cleaning amine for use herein is cyclohexyl propylenediamine (wherein n=0, R1 is cyclohexanyl and R2 is H)

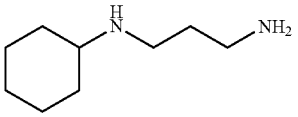

The Amine of Formula (3):

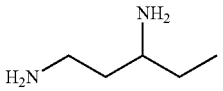

is preferred for use herein.

Mixtures of the above amines are also suitable for use herein.

Surfactant:

The liquid cleaning composition comprises a surfactant. Preferably, the liquid cleaning composition comprises greater than 3% by weight of a surfactant. Preferably, the composition comprises surfactant at a level of from 3% to 60%, more preferably from 5% to 50% and most preferably from 8% to 40% by weight of the composition.

For improved release of stains, the surfactant and the alcohol are in a weight ratio of from 5:1 to 1:1.

The surfactant system preferably comprises an anionic surfactant, more preferably an alkoxylated sulfate anionic surfactant. The system can optionally comprise an amphoteric, zwitterionic, non-ionic surfactant and mixtures thereof.

Preferably, the surfactant system comprises alkyl sulfates and/or alkyl ethoxy sulfates; more preferably a combination of alkyl sulfates and/or alkyl ethoxy sulfates with a combined average ethoxylation degree of less than 5, preferably less than 3, more preferably less than 2 and more than 0.5 and an average level of branching of from about 5% to about 40%.

Preferably, the composition of the present invention will further comprise amphoteric and/or zwitterionic surfactant, more preferably an amine oxide and/or betaine surfactant.

The most preferred surfactant system for the detergent composition of the present invention will therefore comprise: (i) 1% to 40%, preferably 6% to 32%, more preferably 8% to 25% weight of the total composition of an anionic surfactant, preferably an alkoxylated sulfate surfactant (2) combined with 0.01% to 20% wt, preferably from 0.2% to 15% wt, more preferably from 0.5% to 10% by weight of the composition of amphoteric and/or zwitterionic and/or non-ionic surfactant, more preferably an amphoteric and even more preferred an amine oxide surfactant and a non-ionic surfactant. It has been found that such surfactant system in combination with the glycol ether solvent according to the invention will provide the excellent grease cleaning required from a hand dishwashing detergent.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C 8-C 22 alkyl, or acyl group. Such surfactants are employed in the form of water-soluble salts and the salt-forming cation usually is selected from sodium, potassium, ammonium, magnesium and mono-, di- or tri-C 2-C 3 alkanolammonium, with the sodium, cation being the usual one chosen.

The anionic surfactant can be a single surfactant but usually it is a mixture of anionic surfactants. Preferably the anionic surfactant comprises a sulphate surfactant, more preferably a sulphate surfactant selected from the group consisting of alkyl sulphate, alkyl alkoxy sulphate and mixtures thereof. Preferred alkyl alkoxy sulphates for use herein are alkyl ethoxy sulphates.

Preferably the anionic surfactant is alkoxylated, more preferably, an alkoxylated branched anionic surfactant having an alkoxylation degree of from about 0.2 to about 4, even more preferably from about 0.3 to about 3, even more preferably from about 0.4 to about 1.5 and especially from about 0.4 to about 1. Preferably, the alkoxy group is ethoxy. When the branched anionic surfactant is a mixture of surfactants, the alkoxylation degree is the weight average alkoxylation degree of all the components of the mixture (weight average alkoxylation degree). In the weight average alkoxylation degree calculation the weight of anionic surfactant components not having alkoxylated groups should also be included.

Weight average alkoxylation degree=
($x1$*alkoxylation degree of surfactant 1+$x2$*alkoxylation degree of surfactant 2+ . . . )/($x1$+$x2$+ . . . )

wherein x1, x2, . . . are the weights in grams of each anionic surfactant of the mixture and alkoxylation degree is the number of alkoxy groups in each anionic surfactant.

Preferably the anionic surfactant to be used in the detergent of the present invention is a branched anionic surfactant having a level of branching of from about 5% to about 40%, preferably from about 10 to about 35% and more preferably from about 20% to about 30%. Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the anionic surfactant used in the detergent of the invention. Most preferably the branched anionic surfactant is selected from alkyl sulphates, alkyl ethoxy sulphates, and mixtures thereof.

The branched anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, . . . are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

Preferably, the surfactant system comprises at least 50%, more preferably at least 60% and preferably at least 70% of branched anionic surfactant by weight of the surfactant system, more preferably the branched anionic surfactant comprises more than 50% by weight thereof of an alkyl ethoxylated sulphate having an ethoxylation degree of from about 0.2 to about 3 and preferably a level of branching of from about 5% to about 40%.

Sulphate Surfactants

Suitable sulphate surfactants for use herein include water-soluble salts of C8-C18 alkyl or hydroxyalkyl, sulphate and/or ether sulfate. Suitable counterions include alkali metal cation or ammonium or substituted ammonium, but preferably sodium.

The sulphate surfactants may be selected from C8-C18 primary, branched chain and random alkyl sulphates (AS); C8-C18 secondary (2,3) alkyl sulphates; C8-C18 alkyl alkoxy sulphates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees. Commercially available sulphates include, those based on Neodol alcohols ex the Shell company, Lial-Isalchem and Safol ex the Sasol company, natural alcohols ex The Procter & Gamble Chemicals company.

Preferably, the branched anionic surfactant comprises at least 50%, more preferably at least 60% and especially at least 70% of a sulphate surfactant by weight of the branched anionic surfactant. Especially preferred detergents from a cleaning view point art those in which the branched anionic surfactant comprises more than 50%, more preferably at least 60% and especially at least 70% by weight thereof of sulphate surfactant and the sulphate surfactant is selected from the group consisting of alkyl sulphate, alkyl ethoxy sulphates and mixtures thereof. Even more preferred are those in which the branched anionic surfactant has a degree of ethoxylation of from about 0.2 to about 3, more preferably from about 0.3 to about 2, even more preferably from about 0.4 to about 1.5, and especially from about 0.4 to about 1 and even more preferably when the anionic surfactant has a level of branching of from about 10% to about 35%, %, more preferably from about 20% to 30%.

Sulphonate Surfactants

Suitable sulphonate surfactants for use herein include water-soluble salts of C8-C18 alkyl or hydroxyalkyl sulphonates; C11-C18 alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Nonionic surfactant, when present, is comprised in a typical amount of from 0.1% to 30%, preferably 0.2% to 20%, most preferably 0.5% to 10% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred nonionic surfactants are the condensation products of guerbet alcohols with from 2 to 18 moles, preferably 2 to 15, more preferably 5-12 of ethylene oxide per mole of alcohol.

Other suitable nonionic surfactants include alkyl polyglycosides. Alkyl polyglycosides are biodegradable nonionic surfactants which are well known in the art, and can also be used in the compositions of the present invention. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6.

Amphoteric Surfactant

Preferred amphoteric surfactants include amine oxide surfactants. Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3)O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide can further comprise two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Surfactant

Other suitable surfactants include betaines, such as alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y— \quad \text{(I) wherein}$$

$R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n a number from 1 to 10, preferably 2 to 5, in particular 3, x 0 or 1, preferably 1, $R^2$, $R^3$ are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

$$R^1—N^+(CH_3)_2—CH_2COO^- \quad \text{(Ia)}$$

$$R^1—CO—NH(CH_2)_3—N^+(CH_3)_2—CH_2COO^- \quad \text{(Ib)}$$

$$R^1—N^+(CH_3)_2—CH_2CH(OH)CH_2SO_3— \quad \text{(Ic)}$$

$R^1—CO—NH—(CH_2)_3—N^+(CH_3)_2—CH_2CH(OH)CH_2SO_3—$ (Id) in which $R^1$1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, cocoamidopropylbetaine.

Optional Ingredients:

Chelant: The liquid cleaning composition preferably comprises a chelating agent or crystal growth inhibitor. Suitable chelating agents, in combination with the surfactant, improve the shine benefit, as well as specific stain removal performance benefits, such as on grease and bleach sensitive stains. More particularly, water hardness can make it harder for cleaning compositions to dislodge particulates. Chelants, especially chelants are selected from the group consisting of: aminocarboxylate chelant, more preferably a salt of glutamic-N,N-diacetic acid, improve the removal of particulate soils which are stuck to hydrophobic stains, and hence, improve the removal of such hydrophobic stains.

Hard water can also result in the formation of insoluble salts of fatty acids being formed, which reduce suds formation. As such, chelant, and particularly the aforementioned chelants, results in more sustained sudsing, especially in the presence of hard water.

The chelant can be incorporated into the compositions in amounts ranging from 0.05% to 5.0% by weight of the total composition, preferably from 0.1% to 3.0%, more preferably from 0.2% to 2.0% and most preferably from 0.25% to 1.5%.

Suitable phosphonate chelating agents include ethylene diamine tetra methylene phosphonates, and diethylene triamine penta methylene phosphonates (DTPMP), and can be present either in their acid form or as salts.

A preferred biodegradable chelating agent for use herein is ethylene diamine N,N'-disuccinic acid, or alkali metal, or alkaline earth, ammonium or substitutes ammonium salts thereof or mixtures thereof, for instance, as described in U.S. Pat. No. 4,704,233. A more preferred biodegradable chelating agent is L-glutamic acid N,N-diacetic acid (GLDA) commercially available under tradename Dissolvine 47S from Akzo Nobel.

Suitable amino carboxylates include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methyl glycine di-acetic acid (MGDA). Most preferred aminocarboxylate used herein is diethylene triamine pentaacetate (DTPA) from BASF. Further carboxylate chelating agents for use herein include salicylic acid, aspartic acid, glutamic acid, glycine, malonic acid or mixtures thereof.

Thickener: The liquid cleaning composition can comprise a thickener. An increased viscosity, especially low shear viscosity, provides longer contact time and therefore improved penetration of greasy soil and/or particulated greasy soil to improve cleaning effectiveness, especially when applied neat to the surface to be treated, especially when the surface is not horizontal. Moreover, a high low shear viscosity improves the phase stability of the liquid cleaning composition.

Suitable thickeners include polyacrylate based polymers, preferably hydrophobically modified polyacrylate polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

The most preferred thickener used herein is a methacrylic acid/acrylic acid copolymer, such as Rheovis® AT 120, which is commercially available from BASF.

When used, the liquid cleaning composition comprises from 0.1% to 10.0% by weight of the total composition of said thickener, preferably from 0.2% to 5.0%, more preferably from 0.2% to 2.5% and most preferably from 0.2% to 2.0%.

Polymers: The liquid cleaning composition may comprise a polymer. For instance, a polymer further improving the grease removal performance of the liquid cleaning composition due to the specific sudsing/foaming characteristics they provide to the composition. Suitable polymers for use herein are disclosed in EP 2 272 942 (09164872.5) and EP 2 025 743 (07113156.9).

The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; and mixtures thereof.

Typically, the liquid cleaning composition may comprise from 0.005% to 5.0% by weight of the total composition of said polymer, preferably from 0.10% to 4.0%, more preferably from 0.1% to 3.0% and most preferably from 0.20% to 1.0%.

Fatty acid: The liquid cleaning composition may comprise a fatty acid as a highly preferred optional ingredient, particularly as suds supressors. Fatty acids are desired herein as they reduce the sudsing of the liquid cleaning composition when the composition is rinsed off the surface to which it has been applied.

Suitable fatty acids include the alkali salts of a $C_8$-$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms. Suitable fatty acids may be selected from caprylic acid, capric acid, lauric acid, myristic acid, palmitic acid, stearic acid, oleic acid, and mixtures of fatty acids suitably hardened, derived from natural sources such as plant or animal esters (e.g., palm oil, olive oil, coconut oil, soybean oil, castor oil, tallow, ground oil, whale and fish oils and/or babassu oil. For example coconut fatty acid is commercially available from KLK OLEA under the name PALMERAB1211.

Typically, the liquid cleaning composition may comprise up to 6.0% by weight of the total composition of said fatty acid, preferably from 0.1% to 3.0%, more preferably from 0.1% to 2.0% and most preferably from 0.15% to 1.5% by weight of the total composition of said fatty acid.

Other optional ingredients: The liquid compositions may comprise a variety of other optional ingredients depending on the technical benefit aimed for and the surface treated. Suitable optional ingredients for use herein include perfume, builders, other polymers, conditioning polymers, surface modifying polymers, soil flocculating polymers, structurants, emollients, humectants, skin rejuvenating actives, enzymes, carboxylic acids, scrubbing particles, bleach and bleach activators, buffers, bactericides, hydrotropes, colorants, stabilisers, radical scavengers, abrasives, soil suspenders, brighteners, anti-dusting agents, dispersants, dye transfer inhibitors, pigments, silicones, dyes, opacifiers, perfumes, malodor control agents, beads, pearlescent particles, microcapsules, inorganic cations such as alkaline earth metals such as Ca/Mg-ions, antibacterial agents, preservatives and pH adjusters and buffering means.

Method of Cleaning a Surface:

Liquid cleaning compositions described are suitable for cleaning household surfaces. In particular, such compositions are particularly useful for removing stains, especially hydrophobic stains, and most especially hydrophobic stains selected from the group consisting of: oils, fats, polymerized grease, and mixtures thereof.

The method described herein is particularly suited for cleaning surfaces, particularly those found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

The method described herein is also suitable for treating kitchenware, such as pots, pans, plates, bowls, cups, glasses, cutlery, and the like, for instance, using liquid dish cleaning compositions.

The method described herein is also suited for treating hydrophobic stains on porous surfaces, such as textile, granite, ceramic, marble, travertine, slate, limestone, and wood surfaces, especially hard surfaces such as granite, ceramic, marble, travertine, slate, limestone, and wood surfaces.

The method described herein is also suited for treating hydrophobic stains on table ware such as those selected from the group consisting of: ceramics, glass, metal cutlery, and combinations thereof.

The preferred method of cleaning comprises the steps of: optionally pre-wetting the surface, applying the liquid cleaning composition, and washing the surface with water.

The liquid cleaning composition can be applied neat to the surface, or first diluted. When diluted, the liquid cleaning composition is preferably diluted to a dilution level of from 0.001% to 10% by volume before application. In preferred embodiments, the liquid cleaning composition may be diluted to a level of from 0.005% to 5.0% by volume. The liquid cleaning composition may be diluted to a level of from 0.01% to 2% by volume, especially where the liquid cleaning composition has a total surfactant level of greater than or equal to 5% by weight. Where the liquid cleaning composition has a total surfactant level of less than 5% by weight, the liquid cleaning composition may be diluted to a level of from 0.7% to 1.4% by volume. In preferred embodiments, the liquid cleaning composition is diluted with water.

The dilution level is expressed as a percent defined as the fraction of the liquid cleaning composition, by volume, with respect to the total amount of the diluted composition. For example, a dilution level of 5% by volume is equivalent to 50 ml of the liquid cleaning composition being diluted to form 1000 ml of diluted composition.

The diluted composition can be applied by any suitable means, including using a mop, sponge, or other suitable implement.

When applied to the surface, the liquid cleaning composition preferably comprises surfactant, present at a level above the critical micelle concentration. The measurement of surface tension is well known in the art, and can be measured as the concentration at which surface tension becomes independent of the surfactant concentration, measured at 21° C. More preferably, the liquid cleaning composition comprises surfactant at a level of from 1 to 100, preferably 2 to 10 times the critical micelle concentration.

The methods of the present invention are particularly suited to domestic use, since the liquid cleaning compositions of use herein are less harsh to the skin, even when applied neat.

The hard surface may be rinsed, preferably with clean water, in an optional further step.

Alternatively, and especially for particularly dirty or greasy spots, the liquid cleaning composition can be applied neat to the hard surface. It is believed that the combination of solvent, surfactant, and pH results in improved penetration of the stain, and especially hydrophobic stains, leading to improved surfactancy action and stain removal, while being safer for the skin.

By "neat", it is to be understood that the liquid cleaning composition is applied directly onto the surface to be treated without undergoing any significant dilution, i.e., the liquid cleaning composition herein is applied onto the hard surface as described herein, either directly or via an implement such as a sponge, without first diluting the composition. By significant dilution, what is meant is that the composition is diluted by less than 10%, preferably less than 5%, more preferably less than 3% by volume of the composition. Such dilutions can arise from the use of damp implements to apply the composition to the hard surface, such as sponges which have been "squeezed" dry.

In another preferred embodiment of the present invention said method of cleaning a hard surface includes the steps of applying, preferably spraying, said liquid cleaning composition onto said hard surface, leaving said liquid cleaning composition to act onto said surface for a period of time to allow said composition to act, with or without applying mechanical action, and optionally removing said liquid cleaning composition, preferably removing said liquid cleaning composition by rinsing said hard surface with water and/or wiping said hard surface with an appropriate instrument, e.g., a sponge, a paper or cloth towel and the like. Such compositions can be provided in a spray dispenser.

Methods:

A) pH Measurement:

The pH is measured as a 10 wt % product solution in deionised water at 20° C., using a Sartarius PT-10P pH meter with gel-filled probe (such as the Toledo probe, part number 52 000 100), calibrated according to the instructions manual.

B) Reserve Alkalinity:

The reserve alkalinity is measured to pH 7.0 via titration of a 1% solution of the composition using g sodium hydroxide solution, with 100 grams of product at 20° C.

C) Reserve Acidity:

The reserve acidity is measured to pH 7.0 via titration of a 1% solution of the composition using g hydrochloric acid, with 100 grams of product at 20° C.

EXAMPLES

Test Method

Oil Diffusion Test Method

The ability to diffuse through a layer of oil was assessed for compositions comprising alcohols inside and outside of the scope of the product of the invention.

The ability of the compositions to penetrate oil was assessed by measuring the breakthrough time, using the following methodology:

35 gram of water solution containing 0.15% by weight of xanthan gum (supplied by Keltrol™ RD from CP-kelco) was poured into a glossy white ceramic dish plate (Supplied by Ikea-Item: S.Pryle #13781 diameter 26.5 cm).

Olive oil (Sold by Unilever under the Bertoli brand, item number L5313R HO756 MI0002) was dyed red through the addition of 0.05% by weight of red dye (Waxoline Red, red dye pigment supplied by Avecia), stirring for 1 hour in order to provide a homogeneous dye distribution.

Then 2.5 grams of the dyed olive oil was delicately deposited onto the water surface thus forming a thin disk of oil layer. The oil disk diameter was measured to ensure that the diameter did not exceed a variation amongst the replicates of more than 20% from the average value. A drop of the cleaning composition was delicately deposited on to the oil layer, in the middle of the oil disk from a 5 ml Pasteur pipette (Supplied by VWR—Item: 5 ml #612-1684), from a height of less than 5 mm. The breakthrough time was measured as the time recorded from the deposition of the solution drop to the opening of the oil disk identified by the appearance of the water layer in the middle of the oil disk. 8 replicates were required per sample to calculate the average breakthrough time.

Beef Fat Cleaning Method:

A soil composition according to table below was prepared through homogeneously mixing the individual components at room temperature.

Beef Fat Composition

| Ingredient | Supplier | [%, as is] |
|---|---|---|
| Refined Rendered Edible Beef Tallow | Bunge North America Corporate Headquarters 11720 Borman Drive St. Louis, MO 63146 | 99.419 |
| Oleic Acid, 90% (Techn) | Aldrich | 0.274 |
| Palmitic Acid, 99+% | VWR | 0.207 |
| Stearic Acid, 99+% (Gold Label) | Aldrich | 0.101 |
| | Total: | 100 |

The beef fat composition is melted and homogenized with 0.05% of Red dye (Oil red EGN from Aldrich) at 50° C. for 1 hr prior to application. 2.5 g of this soil composition was homogeneously applied using a food brush (5 cm wide from Carrefour Home) over white polypropylene plastic tiles of 8 cm*25 cm. The tile is first kept at 50° C. in an oven during 5 minutes and then stored for 24 h under normal lab conditions (20° C., 40% relative humidity) prior to use. The tiles were placed on a four cleaning tracks and four sponge holders straight-line sheen machine tester (Wet Abrasion Scrub Tester Ref. 903PG/SA/B—Source: Sheen Instruments Limited). 10 ml of the compositions are homogeneously distributed over pre-wetted cellulosic sponges, i.e. cellulosic sponges (Artikel Nr. 33100200 Materialnummer Z 1470000 Zuschnitt Schwamm, feinporig 90×40×40—Source: MAPA GmbH—Bereich SPONTEX Industrie Germany), were pre-wetted with demineralized water (20° C.) and squeezed until no water drained from the sponge anymore (weight sponge: 21 g+/−1 g). Sponges were cut by the supplier to dimensions to fit sponge holders of the cleaning apparatus (9 cm*4 cm). New sponges were boil washed in a washing machine in absence of detergent 3 times prior to use. Four sponges were placed under normal lab conditions (20° C., 40% relative humidity) on the sponge holder of the sheen machine on to the soiled tiles. A weight of 200 g was placed on top of the sponges and the sheen machine was set at a moving speed of 20 cycles/minute. The number of strokes required to clean the soiled tiles were counted (end point=visual assessment) and the test result of 8 replicates (2 internal replicates*4 external replicates, i.e. 4 tiles each product tested twice on a tile) were averaged and reported as a grease cleaning index versus a reference product (grease cleaning index test product=(# strokes reference product/# strokes test product) *100). A higher grease cleaning index represents improved grease cleaning efficacy. Testing products were rotated over the different sponge slots between external replicates.

| % active by weight of the composition | Reference Base |
|---|---|
| Water and minors (preservative, perfume, dye) | To 100 parts |
| Sodium Chloride | 0.4 |
| Sodium bicarbonate | 0.1 |
| Ethanol | 0.34 |
| Polypropylene glycol MW 2000 | 0.05 |
| Mono-ethanolamine | 0.5 |
| Alkyl Dimethyl Amine Oxide (C12-14) | 6.67 |
| Non-ionic Alkyl Ethoxylate (C9-11EO8) | 1.33 |
| pH (10% dilution in demi water) | 10.1 |

Composition

A reference base was formulated through mixing of individual raw materials at normal lab conditions, on top of which 5% by weight of the composition of the alcohols to be tested was added.

Results

Individual Alcohol Assessments

The oil breakthrough time of compositions comprising 5% by weight of the composition of the different alcohols inside and outside the scope of the invention has been compared.

From the data in Tables 1 to 3 below it is clear that a composition comprising alcohols according to the invention (Example formulations) have a faster oil breakthrough time compared to the reference base formulation, while a composition comprising an alcohol solvent outside of the scope of the invention (Comparative example formulations) has a slower oil breakthrough time compared to the reference base formulation. Since the alcohol improves penetration of the liquid composition into the stain, the improved surfactancy in combination with the alkaline pH improves the dispersion of such hydrophobic stains.

Linear Mono-Alcohols

TABLE 1

Impact of linear mono-alcohols on Reference Base formula.

| | Alcohol | Oil Breakthrough Time |
|---|---|---|
| Reference base | — | 63 seconds |
| Comparative example 1 | 1-octanol | 64 seconds |
| Example 1 | 1-hexanol | 18 seconds |
| Example 2 | 1-pentanol | 11 seconds |
| Example 3 | 1-butanol | 57 seconds |
| Comparative example 2 | 1-propanol | 148 seconds |
| Comparative example 3 | 1-ethanol | 105 seconds |

Branched Mono-Alcohols

TABLE 2

Impact of branched mono-alcohol on Reference Base formula.

| | Alcohol | Oil Breakthrough Time |
|---|---|---|
| Reference base | — | 63 seconds |
| Example 4 | 2,6,8 trimethyl-4-nonanol | 30 seconds |
| Example 5 | 3,7 dimethyl-1-octanol | 21 seconds |
| Example 6 | 2-butyl-1-octanol | 7 seconds |
| Example 7 | 2-propyl-1-heptanol | 18 seconds |
| Example 8 | 3,5,5 trimethyl-1-hexanol | 9 seconds |
| Example 9 | 2-ethyl-l-hexanol | 12 seconds |
| Example 10 | 3-methyl-1-butanol | 17 seconds |
| Example 11 | 2-methyl-1-butanol | 22 seconds |
| Comparative example 4 | 2-methyl-1-propanol | 78 seconds |
| Comparative example 5 | 1-methyl-1-ethanol | 111 seconds |

Alkyl Mono-Glycerols

TABLE 3

Impact of alkyl mono-glycerol on Reference Base formula.

| | Alcohol | BT (olive oil) |
|---|---|---|
| Reference base | — | 63 seconds |
| Example 12 | 2-ethylhexylglycerol | 17 seconds |

The ability of linear mono-alcohol, branched mono-alcohol and alkyl glycerol according to the invention to improve hydrophobic stain dispersion has also been confirmed with acidic formulations. The following liquid hard surface cleaning compositions were prepared by simple mixing:

| | A wt % | B wt % | C wt % | D * wt % |
|---|---|---|---|---|
| HLAS | 3.0 | 3.0 | 3.0 | 3.0 |
| Alfonic 10/8 ethoxylate non-ionic surfactant | 6.5 | 6.5 | 6.5 | 6.5 |
| Citric acid | 1.0 | 1.0 | 1.0 | 1.0 |
| Formic acid | 2.0 | 2.0 | 2.0 | 2.0 |
| 1-hexanol | 5.00 | — | — | — |
| 2-propyl-1-heptanol | — | 5.00 | — | — |
| 2-ethylhexylglycerol | — | — | 5.00 | — |
| Minors (including perfume, dyes, and preservative) and Water | up to 100% | up to 100% | up to 100% | up to 100% |
| pH (through NaOH) | 3 | 3 | 3 | 3 |

* Comparative

The average breakthrough time is shown in the table below:

| | A | B | C | D* |
|---|---|---|---|---|
| Average breakthrough time (s) | 35 | 37 | 29 | 92 |

*Comparative

Table 4: Impact of Alcohols on Acidic Base Formulation (D*).

As can be seen from the table above, compositions of the present invention, comprising an alcohol according to the invention, improve the penetration of the composition through hydrophobic material, such as oil. Since the solvent improves penetration of the liquid composition into the stain, the improved surfactancy improves the dispersion of such hydrophobic stains within the acidic pH formulation.

Solvent Mixture Assessment

The oil breakthrough time and beef fat cleaning performance of compositions comprising 5% by weight of the composition of a 50/50 mixture of alcohols or a mixture of alcohols with glycol ethers according to the invention was assessed versus compositions comprising 5% of the individual solvents and versus above alkaline reference base formulation.

From the data in Table 5 below it is clear that a composition comprising a mixture comprising an alcohol according to the invention (Examples 3 and 6) has a faster oil breakthrough time and an improved beef fat cleaning performance compared to compositions comprising a single alcohol or a single glycol ether (Examples 1, 2, 4 and 5) and compared to the reference base formulation.

TABLE 5

Impact of solvent mixtures versus individual solvents on Reference Base formula.

| | Solvent (5%) | Oil Breakthrough Time | Beef Fat Cleaning Index |
|---|---|---|---|
| Reference base | — | 63 seconds | 100 |
| | Alcohol/glycol ether mixture | | |
| Example 1 | 2-ethyl-1-hexanol | 12 seconds | 159 |
| Example 2 | Dipropyleneglycol n-butyl ether | 42 seconds | 146 |
| Example 3 | 50/50 2-ethyl-1-hexanol/ Dipropyleneglycol n-butyl ether | 7 seconds | 178 |
| | Alcohol mixture | | |
| Example 4 | 2-ethyl-1-hexanol | 12 seconds | 159 |
| Example 5 | Diisobutylcarbinol | 8 seconds | 124 |
| Example 6 | 50/50 2-ethyl-1-hexanol/ Diisobutylcarbinol | 7 seconds | 186 |

The alkaline compositions below are non-limiting embodiments of the present invention:

| | E wt % | F wt % | G wt % | H wt % | I wt % | J wt % | K wt % | L wt % | M wt % |
|---|---|---|---|---|---|---|---|---|---|
| Neodol 91-8 | 3 | — | 7.0 | — | — | — | 6.0 | 6.0 | 6.2 |
| Neodol 91-5 | — | 5 | — | 3.5 | — | — | — | — | — |
| C13/15 EO30 nonionic surfactant | — | — | — | 3.5 | — | — | — | — | — |
| C8/10 EO8 nonionic surfactant | 2 | | — | — | 7.0 | 6.0 | — | — | — |
| NaLAS | 5 | | 1.8 | — | — | 2.60 | — | 2.25 | 1.80 |
| Sodium Paraffin Sulphonate | — | — | — | 3.1 | 3.0 | — | 2.60 | — | — |
| C12-14 Dimethyl Amine Oxide | 2 | 5 | 1.50 | 3.9 | 2.0 | 3 | 2 | 1.25 | 1.50 |
| C12-14 Betaine | — | — | — | — | 1.0 | — | 2 | — | — |
| Hydrophobically modified-polyacrylate | — | — | 0.75 | — | — | — | 0.70 | 0.65 | 0.65 |
| Hydrophobically Modified - Hydroxy Ethyl Cellulose | — | — | — | 0.6 | 0.8 | — | — | — | — |
| Xanthan gum | — | — | — | — | — | 0.42 | — | — | — |
| $Na_2CO_3$ | 0.40 | 0.4 | 0.75 | 0.1 | 0.3 | 0.50 | 0.55 | 0.4 | 0.55 |
| Citric Acid | 0.30 | 0.3 | 0.3 | 0.75 | 0.75 | 0.30 | 0.3 | 0.3 | 0.30 |
| Caustic | 0.25 | 0.25 | 0.72 | 0.5 | 0.5 | 0.3 | 0.65 | 0.65 | 0.66 |
| Fatty Acid | 0.15 | — | 1.0 | 0.20 | 0.50 | 0.50 | 0.40 | 0.40 | 1.0 |
| 1-pentanol | 5 | — | — | — | 3 | — | 4 | — | 2 |

-continued

| | E wt % | F wt % | G wt % | H wt % | I wt % | J wt % | K wt % | L wt % | M wt % |
|---|---|---|---|---|---|---|---|---|---|
| 2-propyl-1-heptanol | — | 4 | — | — | 3 | — | — | 3 | — |
| 2-ethyl-1-hexanol | — | — | 6 | — | — | 4 | 3 | — | — |
| 2-ethylhexylglycerol | — | — | — | 4 | — | 2 | — | 3 | 4 |
| diethylene triamine pentaacetate | — | — | — | — | — | — | 0.25 | 0.25 | — |
| Tetrasodium Glutamate Diacetate | — | — | — | 0.3 | 0.3 | — | — | — | — |
| isopropanol | — | — | — | — | — | 2.0 | — | — | — |
| Minors and Water | up to 100% | up to 100% | up to 100% | up to 100% | up to 100% | up to 100% | up to 100% | up to 100% | up to 100% |
| pH | 10.5 | 10.3 | 10.3 | 9.5 | 9.0 | 10.5 | 10.3 | 10.5 | 10.3 |

Example compositions E to M exhibit good or excellent hydrophobic stain removal.

The following acidic compositions were made comprising the listed ingredients in the listed proportions (weight %). The examples herein exemplify the present invention but are not necessarily used to limit or otherwise define the scope of the present invention.

| Examples: | N | O | P | Q | R | S | T | U | V |
|---|---|---|---|---|---|---|---|---|---|
| Formic acid | 4.0 | 2.0 | 1.8 | 1.8 | 2.5 | 2.0 | 2.0 | 2.0 | 4.0 |
| Acetic acid | — | 3.5 | 8.0 | 8.0 | 3.0 | 6.0 | 7.0 | — | — |
| Citric acid | — | — | — | — | — | — | — | 8.0 | 2.0 |
| Lactic acid | — | — | — | 1.0 | 2.0 | — | 1.0 | — | 1.5 |
| Neodol 91-8 | 0.5 | 2.2 | 2.2 | 2.2 | 1.5 | 0.45 | 2.5 | 1.8 | 2.0 |
| Sulphated Safol 23 | 2.0 | — | — | — | 1.0 | 2.0 | — | — | — |
| Kelzan T | 0.40 | 0.25 | 0.25 | 0.25 | 0.25 | 0.10 | 0.40 | 0.30 | 0.25 |
| Poly Vinyl Pyrrolidone | 0.25 | 0.05 | 0.05 | 0.25 | 0.05 | — | 0.25 | 0.10 | 0.05 |
| 1-hexanol | 5 | — | — | — | 2 | — | 2 | — | 3 |
| 2-propyl-1-heptanol | — | 3 | — | — | 2 | — | — | 4 | — |
| 2-ethyl-1-hexanol | — | — | 4 | — | — | 3 | 4 | — | — |
| 2-ethylhexylglycerol | — | — | — | 6 | — | 3 | — | 2 | 3 |
| KOH - to pH: | 2.3 | — | 2.9 | 2.8 | 2.8 | — | — | — | — |
| NaOH - to pH: | — | 2.2 | — | — | — | 2.5 | 2.3 | 2.0 | 2.2 |
| Minors and Water: | up to 100% | up to 100% | up to 100% | up to 100% | up to 100% | up to 100% | up to 100% | up to 100% | up to 100% |

Example compositions N to V exhibit good or excellent limescale removal performance and hydrophobic stain removal, whilst providing good surface safety on the treated surface.

The impact of the alcohols according to the invention was also assessed towards their ability to sustain suds over time when added to a detergent composition. The following liquid hard surface cleaning compositions, suitable for use as hand dishwashing detergent compositions, trimmed at equal finished product viscosity, were prepared by simple mixing of the individual raw materials:

| | W wt % | X wt % | Y wt % | Z* wt % |
|---|---|---|---|---|
| C1213alkyl ethoxy (0.6) sulfate | 20.8 | 20.8 | 20.8 | 20.8 |
| C1214 dimethyl amine oxide | 6.9 | 6.9 | 6.9 | 6.9 |
| Greenbentin DE/080 | 1.4 | 1.4 | 1.4 | 1.4 |
| NaCl | 0.7 | 0.7 | 0.5 | 0.7 |
| Na3-citrate | 1.0 | 1.0 | 1.0 | 1.0 |
| Polypropyleneglycol | 0.75 | 0.75 | 0.75 | 0.75 |

-continued

| | W wt % | X wt % | Y wt % | Z* wt % |
|---|---|---|---|---|
| Ethanol | — | — | 1.9 | 5.0 |
| 1-pentanol | 5 | — | — | — |

-continued

| | W wt % | X wt % | Y wt % | Z* wt % |
|---|---|---|---|---|
| 2-methyl-1-butanol | — | 5 | — | — |
| 2-ethylhexylglycerol | — | — | 5 | — |
| Minors (including perfume, dyes, and preservative) and Water | To 100% | To 100% | To 100% | To 100% |
| pH (measured as 10% dilution in demi water at 20 degrees C.) - with NaOH | 9.0 | 9.0 | 9.0 | 9.0 |

*Comparative 10 g of each the above samples were added to glass vials (diameter 2 cm, height 8.5 cm), which have then been closed. All of the vials were placed into a rack and manually shaken together for 20 seconds in an upwards downwards movement (10 to 15 cm up from the start point and 10 to 15 cm down back to the start point) at a constant frequency of 1 upwards-downwards shake per second. The foam height in each sample was measured straight after shaking and re-measured after 1 hr.

Table 6 shows the foam heights measured for the different samples:

TABLE 6

Impact of alcohols on foaming performance of a reference base formula (Z*).

| | W | X | Y | Z* |
|---|---|---|---|---|
| Suds height immediately after shaking | 4.5 cm | 4.2 cm | 4.3 cm | 0.3 cm |
| Suds height after 1 hour | 2.7 cm | 2 cm | 2.7 cm | 0.2 cm |

As can be seen from the table above, compositions of the present invention, comprising an alcohol according to the invention, boost both initial foam height as well as help sustaining the foam height over time compared to the comparative example formula Z* not comprising an alcohol according to the invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A method of removing hydrophobic stains from a hard surface, comprising the steps of:

a) optionally pre-wetting the hard surface having a hydrophobic stain;

b) applying a liquid cleaning composition having a pH of less than 10 and comprising a surfactant and an alcohol comprising an alkyl mono-glycerol, wherein the alkyl mono-glycerol is selected from the group consisting of ethylhexylglycerol, propylheptylglycerol, and mixtures thereof;

c) rinsing or wiping the hard surface with water; and d) removing the hydrophobic stain from the hard surface.

2. The method according to claim 1 wherein the liquid cleaning composition is applied using a spray.

3. The method according to claim 1 wherein the liquid cleaning composition is left on the hard surface for at least 15 seconds before rinsing or wiping the hard surface.

4. The method according to claim 1 wherein the alcohol further comprises a C4-C6 linear mono-alcohol selected from the group consisting of pentanol, hexanol, and mixtures thereof.

5. The method according to claim 1 wherein the alcohol further comprises a branched C4-C10 mono-alcohol.

6. The method according to claim 1, wherein the alcohol further comprises a branched C4-C8 mono-alcohol.

7. The method according to claim 1 wherein the composition further comprises a glycol ether solvent selected from the group consisting of glycol ethers of:

i. Formula I: $R_1O(R_2O)_nR_3$;

ii. Formula II: $R_4O(R_5O)_mR_6$; and iii. mixtures thereof;

wherein:

$R_1$ is a linear or branched $C_4$, $C_5$ or $C_6$ alkyl or a substituted or unsubstituted phenyl, $R_2$ is ethyl or isopropyl, $R_3$ is hydrogen or methyl, and n is 1, 2 or 3;

$R_4$ is n-propyl or isopropyl, $R_5$ is isopropyl, $R_6$ is hydrogen or methyl and m is 1, 2 or 3.

8. The method according to claim 1 wherein the composition further comprises a cyclic amine.

9. The method according to claim 1 wherein the composition further comprises a cleaning amine selected from the group consisting of:

i. polyetheramines of Formula (I), Formula (II), Formula (III):

Formula (I)

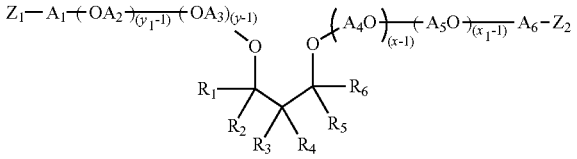

Formula (II)

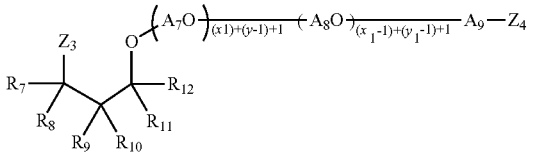

wherein each of $R_1$-$R_{12}$ is independently selected from H, alkyl, cycloalkyl, aryl, alkylaryl, or arylalkyl, wherein at least one of $R_1$-$R_6$ and at least one of $R_7$-$R_{12}$ is different from H, each of $A_1$-$A_9$ is independently selected from linear or branched alkylenes having about 2 to about 18 carbon atoms, each of $Z_1$-$Z_4$ is independently selected from OH or $NH_2$, wherein at least one of $Z_1$-$Z_2$ and at least one of $Z_3$-$Z_4$ is $NH_2$, wherein the sum of x+y is in the range of about 2 to about 200, wherein x≥1 and y≥1, and the sum of $x_1+y_1$ is in the range of about 2 to about 200, wherein $x_1 \geq 1$ and $y_1 \geq 1$;

Formula (III)

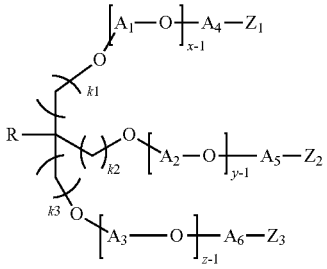

wherein: R is selected from H or a C1-C6 alkyl group, each of $k_1$, $k_2$, and $k_3$ is independently selected from 0, 1, 2, 3, 4, 5, or 6, each of $A_1$, $A_2$, $A_3$, $A_4$, $A_5$, and $A_6$ is independently selected from a linear or branched alkylene group having from about 2 to about 18 carbon atoms or mixtures thereof, x≥1, y≥1, and z≥1, and the sum of x+y+z is in the range of from about 3 to about 100, each of $Z_1$, $Z_2$, and $Z_3$ is independently selected from $NH_2$ or OH, where at least two of $Z_1$, $Z_2$, and $Z_3$ are $NH_2$; and the polyetheramine has a weight average molecular weight of from about 150 to about 1000 grams/mole;

ii. amines of Formula (1)

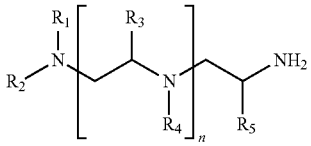

wherein: $R_1$, $R_2$, $R_3$, $R_4$, and $R_5$ are independently selected from —H, linear, branched or cyclic alkyl or alkenyl having from about 1 to about 10 carbon atoms and n=0-3;

iii. amines of Formula (2):

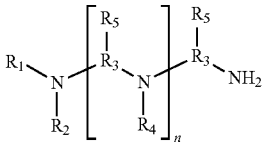

wherein $R_1$ and $R_4$ are independently selected from —H, linear, branched or cyclic alkyl or alkenyl having from about 1 to about 10 carbon atoms; and $R_2$ is a linear, branched or cyclic alkyl or alkenyl having from about 3 to about 10 carbons, $R_3$ is a linear or branched alkyl from about 3 to about 6 carbon atoms, $R_5$ is H, methyl or ethyl and n=0-3;

iv. the amine of Formula (3)

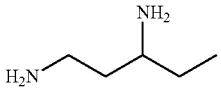

and v. mixtures thereof.

10. The method according to claim 1 wherein the surfactant comprises a nonionic surfactant selected from the group consisting of alkoxylated nonionic surfactants, alkyl polyglycosides, amine oxides, and mixture thereof.

11. The method according to claim 1 wherein the surfactant comprises an anionic surfactant and an amphoteric and/or a zwitterionic surfactant wherein the anionic surfactant and the amphoteric and/or the zwitterionic surfactant are in a weight ratio of from about 4:1 to about 3:1.

12. The method according to claim 1 wherein the surfactant comprises an anionic surfactant and wherein the anionic surfactant is an alkyl alkoxylated sulphate.

13. The method according to claim 1 wherein the surfactant comprises an amphoteric surfactant and wherein the amphoteric surfactant comprises at least 60% by weight of an amine oxide surfactant.

14. The method according to claim 1 wherein the surfactant comprises an amphoteric and a zwitterionic surfactant wherein the amphoteric and the zwitterionic surfactant are in a weight ratio of from about 2:1 to about 1:2.

15. The method according to claim 8 wherein the cyclic amine is selected from the group consisting of 1, 3-bis (methylamine)-cyclohexane, 2-methylcyclohexane-1,3-diamine, 4-methylcyclohexane-1,3-diamine and mixtures thereof.

* * * * *